United States Patent [19]

Chambers

[11] 4,377,206

[45] Mar. 22, 1983

[54] WELL BLOWOUT PREVENTION DEVICE

[75] Inventor: Roland A. Chambers, Waumsutter, Wyo.

[73] Assignee: Marathon Oil Company, Findlay, Ohio

[21] Appl. No.: 202,539

[22] Filed: Oct. 31, 1980

[51] Int. Cl.[3] ..... E21B 33/06; E21B 34/02

[52] U.S. Cl. ..... 166/97; 166/88

[58] Field of Search ..... 166/316, 325, 75 R, 166/84, 172, 97, 95, 65 R, 66, 113, 105; 137/527.8, 522; 277/30

[56] References Cited

U.S. PATENT DOCUMENTS

| | | | |
|---|---|---|---|
| 1,463,103 | 7/1923 | Thorsten | 137/527.8 |
| 1,572,394 | 2/1926 | Krebs | 277/166 X |
| 1,627,945 | 5/1927 | Wigle | 166/84 |
| 2,124,840 | 7/1938 | Wrigley | 166/84 |
| 3,144,876 | 8/1964 | Frye | 137/527.8 |
| 3,468,374 | 9/1969 | Reeves | 166/84 |
| 3,532,163 | 10/1970 | Ecuer | 166/84 |
| 4,109,713 | 8/1978 | Clow | 166/84 |

*Primary Examiner*—Stephen J. Novosad
*Assistant Examiner*—Joseph Falk
*Attorney, Agent, or Firm*—Jack L. Hummel

[57] ABSTRACT

The invention provides a device for preventing well blowouts in sucker rod pumping systems and particularly for sensing the parting of the polish rod from the stuffing box and preventing fluid flow through the stuffing box to the atmosphere. The device (200) includes a valve body (220) inserted between the stuffing box (70) and the production-tee (30), a valve (310, 320) which is selectively capable of being opened or closed in the valve body (220), means (230, 232) for actuating the valve (320), and a wear block (330) abutting against a polish rod (50) for sensing when the polish rod (50) parts from the stuffing box (70). When the polish rod (50) parts from the stuffing box (70), the lever (230) causes the valve (320) to rapidly close to prevent blowout of the fluid in the well bore (80). When the wear block (330) wears down to a predetermined amount, the lever (230) senses and effectuates a signaling system (240) to indicate that the wear block (330) should be replaced.

5 Claims, 7 Drawing Figures

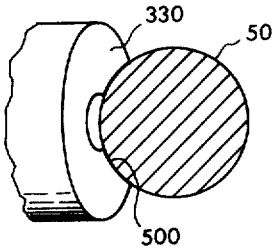
Fig. 5
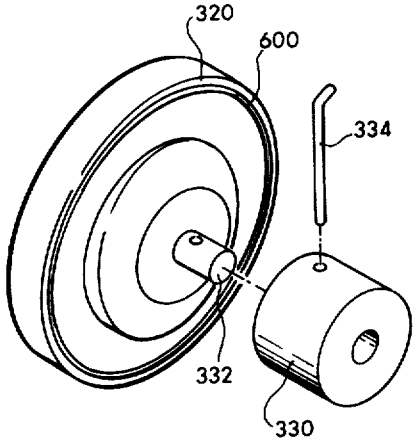
Fig. 6
Fig. 7
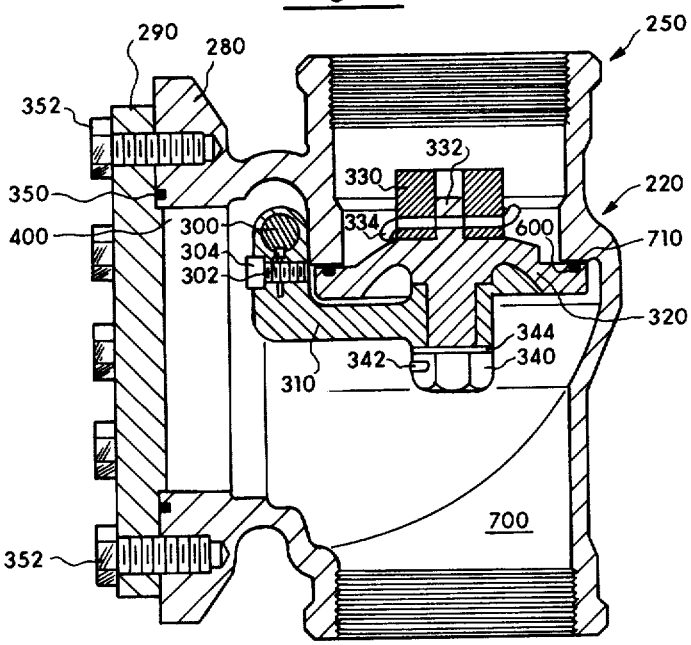

WELL BLOWOUT PREVENTION DEVICE

TECHNICAL FIELD

The present invention relates to a device for preventing well blowouts and, more particularly, to valves for preventing fluid from flowing to the atmosphere in the event the polish rod should part in a sucker rod well pumping system.

BACKGROUND ART

In FIG. 1 is shown a conventional sucker rod well pumping system 10. The pumping system 10 shown in FIG. 1 is well known in the art and functions to reciprocally pump upwardly and downwardly, as shown by arrow 20, in order to cause fluid, such as oil or gas, to flow outwardly through a production tee 30 in the direction of arrow 40. The details of the sucker rod well pumping system 10 are not necessary for an understanding of the present invention. However, the sucker rod well pumping system 10 is interconnected with a polish rod 50 by means of a cable 60. The polish rod passes through a stuffing box 70 which is interconnected to the production tee 30 which in turn is interconnected with the well bore 80. The stuffing box 70 conventionally serves a seal around the polish rod 50 to prevent the pumped fluid from leaking out.

As shown in FIG. 1, a problem exists with this prior art approach in that should the polish rod 50, for any reason, break or part, as illustrated in FIG. 1 at location 90, the polish rod 50 will fall downwardly into the well bore 80 causing an opening in the stuffing box 70 for the fluid 100 to spill out. Typically, a major blowout is not expected from breakage of the polish rod 50. However, entrained gas in the liquid may create a minor spill and consequently an unsightly mess and the resulting expense of cleanup. Furthermore, the sucker rod pumping system 10 may be located in a congested and public area and from an environmental and esthetic viewpoint, it becomes necessary to prevent even minor spills from occurring.

No prior art or conventional approach for preventing blowouts through the stuffing box due to the breakage of the polish rod in a sucker rod pumping system is known.

DISCLOSURE OF INVENTION

The problem faced in preventing well blowouts caused by separation of the polish rod from the stuffing box in sucker rod pumping systems is to design a valve which can be immediately operative upon the parting of the polish rod to prevent the well blowout from occurring through the stuffing box, and, at the same time, to activate a control to shut down the sucker rod well pumping system.

The well blowout prevention valve of the present invention provides a solution to the problem and includes a valve mounted below the stuffing box and including a sensor for sensing the parting of the polish rod for immediately closing a valve in the well bore passageway, a set of counter weights to effectuate the immediate closure of the valve and a switch responsive to the closure of the valve for shutting down the sucker rod well pumping system. The valve utilizes a wear block sensor which abuts against the operating polish rod to hold open the valve. When the sensor wears down and replacement is required a signal is generated.

BRIEF DESCRIPTION OF THE DRAWING

Details of the present invention are described in the accompanying drawing:

FIG. 5 sets forth an illustration of the wearing of the wear block sensor of the present invention against the polish rod;

FIG. 6 sets forth an exploded perspective view of the wear block sensor of the present invention;

FIG. 7 sets forth, in cross-section, the interior elements of the well blowout prevention valve of the present invention as shown in FIG. 3.

BEST MODE FOR CARRYING OUT THE INVENTION

Figure 1:
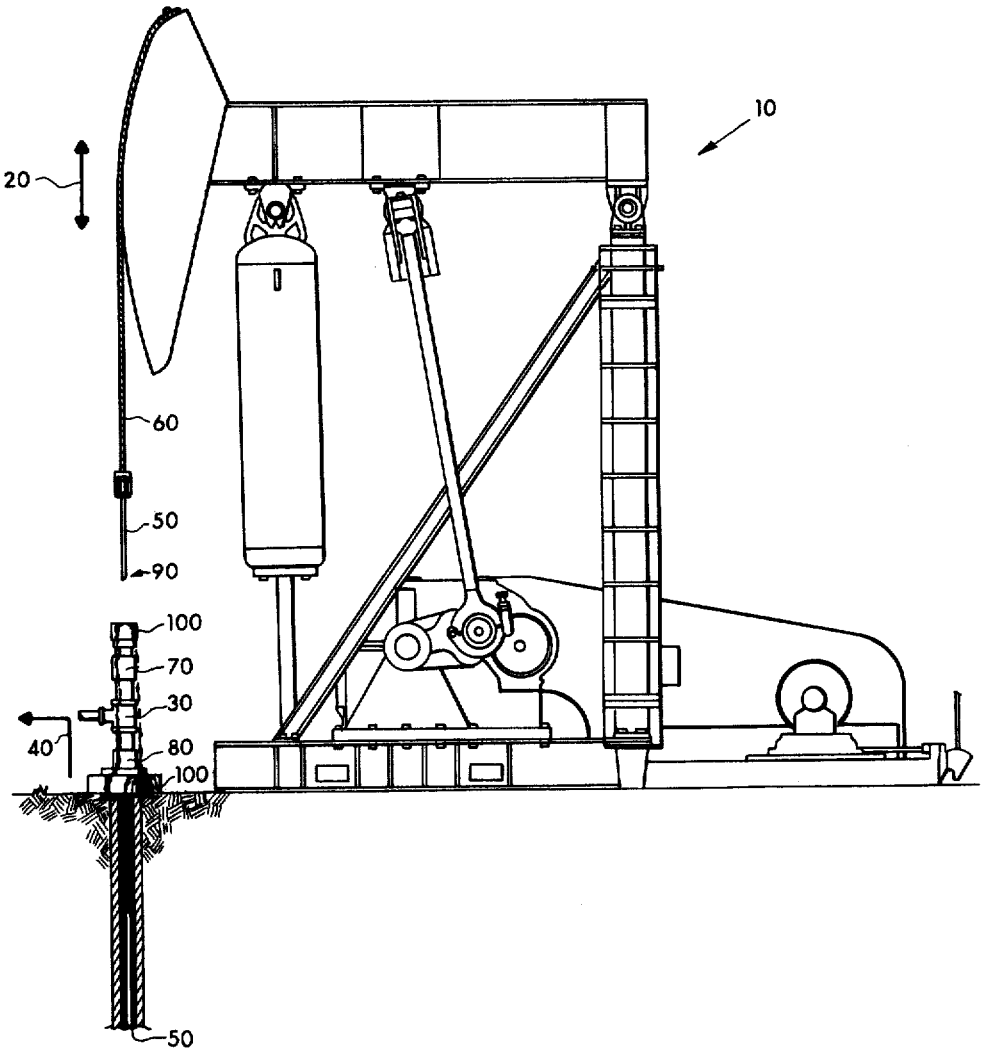
FIG. 1 sets forth an illustration of a conventional sucker rod well pumping system having a minor spill due to the parting of the polish rod.
Figure 2:
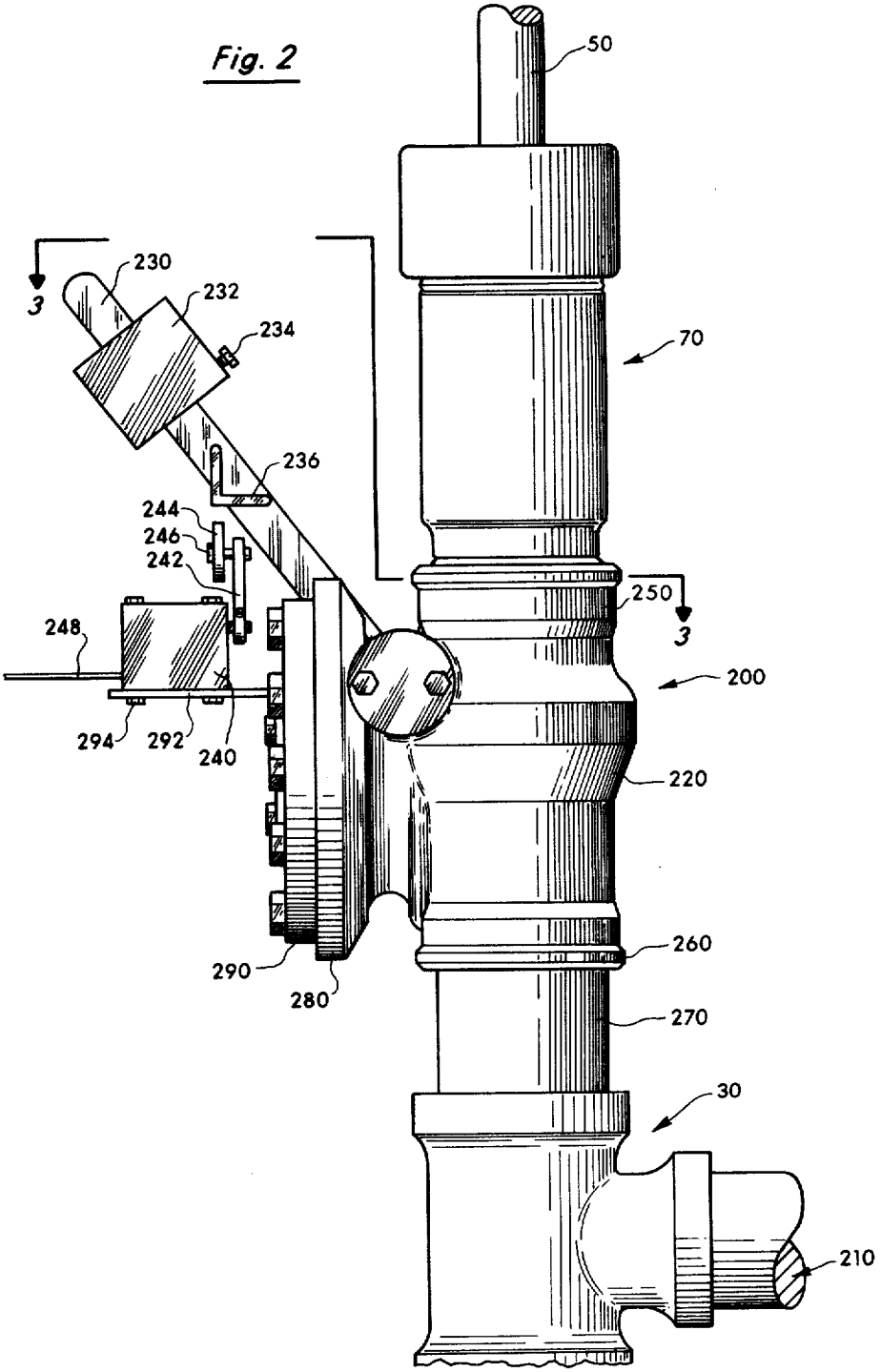
FIG. 2 sets forth a side planar view of the well blowout prevention valve of the present invention.

The well blowout prevention valve 200 of the present invention is shown in FIG. 2 mounted between a conventional stuffing box 70 and a conventional production tee 30. As mentioned, the purpose of the stuffing box 70 is to permit the polish rod 50 to move upwardly and downwardly through the stuffing box 70 and, yet, to prevent the passage of any fluid in the passageway of the well bore from spilling out. Hence, the stuffing box 70 serves as a seal around the polish rod 50. The lower end of the well blowout prevention valve 200 is interconnected to the production tee 30 which has as its purpose the provision of a passageway 210 for which the pumped fluids may flow outwardly from the well bore under the action of the sucker rod pumping system.

The well blowout prevention valve 200 shown in FIG. 2 includes a main body portion 220, a counterweight lever 230, and an electrical sensor 240. The valve body 220 has its top end 250 interconnected with the stuffing box 70 to be in fluid-tight engagement therewith. The lower end 260 of the valve body 220 is interconnected with the production tee 230 by means of an extension casing 270. It is to be expressly understood that all joints involving the stuffing box, the extension casing, and the production tee are fluid-tight. On one side of the valve body 220 is formed an access plate 280 to which is interconnected a circular flat plate 290. Removal of the circular plate 290 from the access plate 280 allows access to the interior of the valve body 220.

The lever 230 has an adjustable counterweight 232 which can be adjusted upwardly or downwardly along the lever 230 by means of an adjustment screw 234. Also disposed on the lever 230 is an actuating plate 236.

The electrical sensor 240 has a lever 242 with a sensing arm 244 disposed thereon by means of a nut 246 which when abutted by the actuating plate 236 causes the switch 240 to change state and to send a suitable electrical signal over cable 248 to the sucker rod well pumping system 10 to shut down or deactivate the system 210. The sensor switch 240 is mounted to a plate 292 by means of bolts 294 which in turn are affixed to the circular plate 290.

Figure 3:
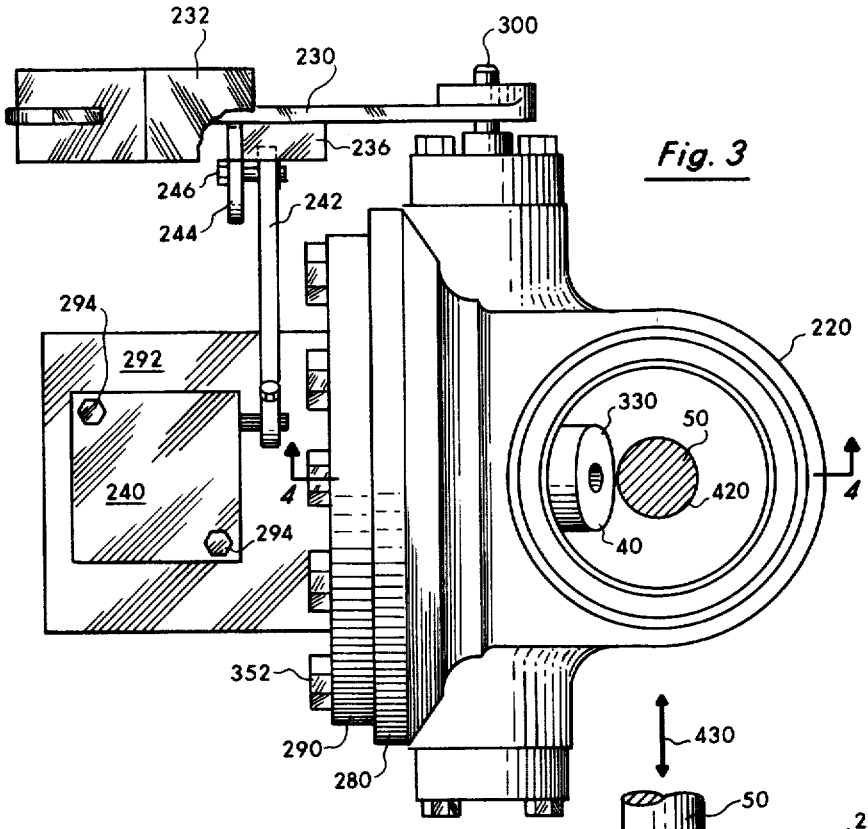
FIG. 3 sets forth a top planar view, in partial cross-section, of the well blowout prevention valve of the present invention as shown in FIG. 2.
Figure 4:
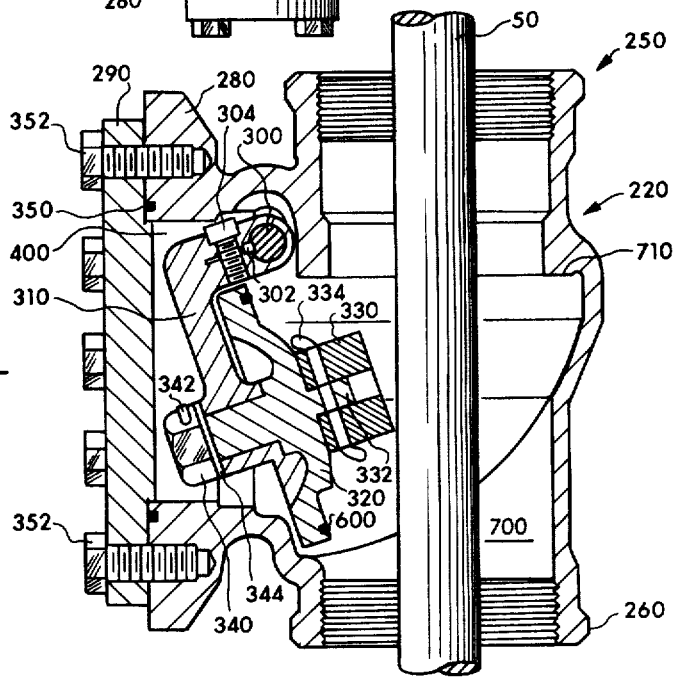
FIG. 4 sets forth, in cross-section, the interior elements of the well blowout prevention valve shown in FIG. 3 in the open position.

In FIGS. 3 and 4, the interior of the valve body 220 is shown to include a shaft 300 interconnected with the counterweight lever arm 230 and further interconnected to a valve arm 310. The valve arm 310, in turn, is interconnected to a clapper 320 which has disposed thereon a wear block 330.

The valve arm 310 engages the shaft 300 at a precise position determined by key 302 and is tightened thereon by means of a socket head cap screw 304. Hence, the valve arm 310 firmly engages the shaft 300 at a precise orientation.

The clapper 320 in turn is mounted to the valve arm by means of a nut 340 engaging a threaded portion of the clapper 320 which is disposed upwardly through a formed hole in the valve arm 310. A retaining pin 342 is mounted through the nut 340 to firmly mount the nut 340 onto the clapper 320 at a predetermined fixed position. A space 344 exists between the clapper 320 and the valve arm 310 in order to allow slight movement of the clapper 320 with respect to the arm 310.

A circular wear block 330 is mounted to the clapper 320 over an outwardly extending shaft 332 of the clapper 320 and is affixed thereto by means of a retaining pin 334.

As shown in FIG. 4, the circular plate 290 is firmly affixed to the access plate 800 against an O-ring seal 350 by means of a number of threaded bolts 352 disposed around the outer periphery of the circular plate 290. Between the access plate 280 and the valve body 220 is a formed chamber 400 in which the valve arm 310, and the clapper 320 normally reside when the valve is in the open position.

As shown in FIGS. 3 and 4, the outer periphery 410 of the wear block 330 engages the outer periphery 420 of the polish rod 50. In operation, the polish rod 50 is reciprocating upwardly and downwardly in the direction of the arrow 430, as shown in FIG. 4, and causes wear to occur along the area of engagement between the wear block 330 and the polish rod 50. This is best shown by reference to FIG. 5 which depicts the wear block, after a period of time, having an area of wear 500 conforming to the outer periphery of the polish rod 50.

As the wear block 330 wears, and with reference back to FIG. 2, the lever 230 will drop, corresponding to the wear, until a point is reached when actuation plate 236 actuates the switch 240 to cause the well pumping system 10 to shut down. At this time, the operators of the system will check the integrity of the pumping system and ascertain that the lever arm 230 has dropped indicating that a new wear block 330 must be installed. Installation can be performed by removal of the circular plate 290 from the access plate 280 thereby providing access to the interior of the valve. The wear block 330 is designed so that the switch 240 will be actuated before the outer edge of the clapper shaft 332 abuts the polish rod 50.

As shown in FIG. 6, the wear block 330 can be easily removed from the clapper 320 by removing the retaining pin 334. The wear block 330 in the preferred embodiment is made from a cylinder of teflon-like material but it can also be made from any type of nylon or plastic material having a low coefficient of friction. The wear block 330 is firmly affixed to the shaft 332 of the clapper 320. Disposed around the wear block 330 on the clapper 320 is an O-ring 600.

In FIG. 7, the clapper 320 has closed across the passageway 700 so that the O-ring 600 firmly abuts against a shoulder 710 of the valve body 220. When the polish rod 50 drops, it no longer abuts against the wear block 330 and through action of the counterweight 232 on the lever 230, the valve firmly closes in a fluid-tight seal. Furthermore, the pressure of the entrained fluid from below the closed valve causes it to more firmly abut against the shoulders 710. And, the closing of the valve causes the switch 240 to be activated to effectuate the closedown of the well pumping system.

It is to be expressly understood, that the valve configuration including the use of the lever 230 with counterweights 232, the switch 240, the valve arm 310 and valve clapper 320 is conventional and can be of the type manufactured by Judd Valve Company, Inc., Tulsa, Okla. used as a counterweighted check valve for vertical installation (flow down service). The present invention represents a change to this valve in that, as best shown in FIG. 6, the raised portion 332 is added to the clapper 320 and onto the raised portion 332 is disposed the wear block 330 retained by pin 334. Furthermore, the wear block acts as the sensor to sense when the valve is to be actuated. Conventionally, the valve would be actuated internally when the fluid, flowing downwardly stops flowing. Hence, the other details of the operation of the valve are not required to the present understanding of the invention and to the use of a wear block abutting against the polish rod 50.

The present invention sets forth a valve for sensing the parting or breaking of the polish rod in a sucker rod well pumping system which sensing system immediately actuates a valve closure. Furthermore, as the sensor wears down, a signal or indication is raised before changing of the sensor. It is to be expressly understood that the generation of a signal when the wear block reaches a predetermined amount, could be generated through use of a separate electrical sensor which would be activated without causing the well pumping system to shut down, as done, in the preferred embodiment. In the present embodiment shown in the drawing, the location of the apparatus of the present invention is between the stuffing box 70 and the production tee 230. However, it is to be understood that the valve of the present invention can be located anywhere below the stuffing box, including being below the production tee 30 and, with suitable modifications, above the stuffing box.

Although the device of the present invention has been specifically set forth in the above disclosure, it is to be understood that modifications and variations can be made thereto which would still fall within the scope and coverage of the appended claims.

I claim:

1. A well blowout prevention device (200) for a sucker rod well pumping system (10) on a well bore (80) for pumping fluid (100) contained in said well bore through a production-tee (30), said pumping system (10) having a reciprocating polish rod (50) connected through a stuffing box (70) to said production-tee (30), said device (200) comprising:

a fluid-tight body (220) connected below said stuffing box (70), said body (220) having a formed passageway (700) through which said polish rod (50) extends, a pivotal valve (310, 320) disposed in said body (220), said valve being capable of occupying an open position and a closed position, a wear block (330) on a portion of said valve (310, 320), one surface (500) of said wear block (330) abutting said polish rod, and at least one counterweight (232) connected to said valve (310, 320) for biasing said wear block (330) against said polish rod (50) to normally maintain said valve (310, 320) in said open position, when said polish rod (50) separates from said stuffing box (70) and falls through said passageway (700) said counterweight (232) acting to force said valve (310, 320) into said closed position wherein said valve (310, 320) closes across said passageway (700) in fluid-tight engagement with said body (220), said closed valve being oriented in said passageway (700) so that any fluid (100) coming up from the well bore further biases said valve in said closed position.

2. The well blowout prevention device of claim 1 further comprising:

means (240) operative upon said counterweight (232) closing said valve (310, 320) for deactivating said sucker rod well pumping system (10).

3. The well blowout prevention device of claim 2 in which said deactivating means (240) is further operative when said wear block (330) wears down a predetermined amount from said reciprocating action of said polish rod (50).

4. A well blowout prevention device (200) for a sucker rod well pumping system (10) on a well bore (80) for pumping fluid (100) contained in said well bore (80) through a production-tee (30), said pumping system (10) having a reciprocating polish rod (50) connected through a stuffing box (70) to said production-tee (30), said device (200) comprising:

a fluid-tight body (220) connected to the well bore (80), said body (220) having a formed passageway (700) through which said polish rod (50) extends, valve means (310, 320) pivotally connected to said housing for selectively opening and closing said passageway (700), means (330) on said opening and closing means (310, 320) for abutting against said polish rod (50), said abutting means holding open said valve means (310, 320) when abutting against said polish rod (50), wherein said abutting means (330) comprises a cylindrically shaped block (330) mounted near the center of said valve means (310, 320), said block (330) being formed from material capable of wearing against said polish rod with a low coefficient of friction, means (230, 232) connected to said valve means (310, 320) for closing said valve means in said passageway when said polish rod (50) separates and falls through said passageway (700), and means (230, 240, 300, 310, 320) connected to said block (330) for generating a signal when a predetermined amount of said block wears away.

5. A well blowout prevention device (200) for a sucker rod well pumping system (10) on a well bore (80) for pumping fluid (100) contained in said well bore (80) through a production-tee (30), said pumping system (10) having a reciprocating polish rod (50) connected through a stuffing box (70) to said production-tee (30), said device (200) comprising:

a fluid-tight body (220) connected to the well bore (80), said body (220) having a formed passageway (700) through which said polish rod (50) extends, valve means (310, 320) pivotally connected to said housing for selectively opening and closing said passageway (700), means (330) on said opening and closing means (310, 320) for abutting against said polish rod (50), said abutting means holding open said valve means (310, 320) when abutting against said polish rod (50), means (230, 232) connected to said valve means (310, 320) for closing said valve means in said passageway when said polish rod (50) separates and falls through said passageway (700), and means (230, 240, 300, 310, 320) connected to said block (330) for deactivating said sucker rod well pumping system (10).

* * * * *